US010629052B2

(12) United States Patent
Huster et al.

(10) Patent No.: US 10,629,052 B2
(45) Date of Patent: Apr. 21, 2020

(54) BED ALERT CONDITION CONFIGURATION USING A REMOTE COMPUTER DEVICE

(71) Applicant: Hill-Rom Services, Inc., Batesville, IN (US)

(72) Inventors: Keith A. Huster, Sunman, IN (US); Dan R. Tallent, Hope, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 15/297,251

(22) Filed: Oct. 19, 2016

(65) Prior Publication Data

US 2017/0124844 A1 May 4, 2017

Related U.S. Application Data

(60) Provisional application No. 62/247,383, filed on Oct. 28, 2015.

(51) Int. Cl.

| | |
|---|---|
| ***G08B 21/18*** | (2006.01) |
| ***A61G 7/00*** | (2006.01) |
| ***A61G 7/05*** | (2006.01) |
| ***A61G 7/012*** | (2006.01) |
| ***A61G 7/015*** | (2006.01) |
| ***A61G 7/018*** | (2006.01) |

(52) U.S. Cl.

CPC ..... *G08B 21/18* (2013.01); *A61G 7/00* (2013.01); *A61G 7/001* (2013.01); *A61G 7/012* (2013.01); *A61G 7/015* (2013.01); *A61G 7/018* (2013.01); *A61G 7/0507* (2013.01); *A61G 7/0524* (2016.11); *A61G 7/0527* (2016.11); *A61G 7/0528* (2016.11); *A61G 2203/20* (2013.01); *A61G 2203/42* (2013.01); *A61G 2203/44* (2013.01); *A61G 2203/70* (2013.01)

(58) Field of Classification Search

CPC ..... G08B 21/18
USPC ..... 340/679, 539.1, 506
See application file for complete search history.

(56) References Cited

U.S. PATENT DOCUMENTS

| | | | | |
|---|---|---|---|---|
| 3,264,769 | A * | 8/1966 | Hardesty | G02B 6/0031 116/287 |
| 5,319,363 | A | 6/1994 | Welch et al. | |
| 5,552,806 | A | 9/1996 | Lenchik | |
| 5,633,538 | A * | 5/1997 | Nickerson | B60Q 3/88 307/10.8 |
| 5,771,511 | A | 6/1998 | Kummer et al. | |

(Continued)

FOREIGN PATENT DOCUMENTS

| | | | |
|---|---|---|---|
| EP | 2438897 | A2 | 4/2012 |
| EP | 2777670 | A1 | 9/2014 |
| WO | 2007056342 | A2 | 5/2007 |

OTHER PUBLICATIONS

Extended European Search Report, European Application No. 16195588.5, completed Mar. 2, 2017, (6 pages).

*Primary Examiner* — Eric Blount
(74) *Attorney, Agent, or Firm* — Barnes & Thornburg LLP

(57) ABSTRACT

A patient support apparatus, such as a hospital bed, includes an alert light assembly having indicators that are individually illuminated to convey information regarding respective alert conditions. The indicators each have indicia related to a particular condition of the patient support apparatus. The illuminated indicators are each sufficiently large so as to be seen from afar, such as on the order of ten feet or more.

7 Claims, 7 Drawing Sheets

(56) References Cited

U.S. PATENT DOCUMENTS 6,304,060 B1 * 10/2001 Dernehl ..... H02J 7/0047 320/132
6,791,460 B2 9/2004 Dixon et al.
7,010,369 B2 3/2006 Borders et al.
7,154,397 B2 12/2006 Zerhusen et al.
7,237,287 B2 7/2007 Weismiller et al.
7,319,386 B2 1/2008 Collins, Jr. et al.
8,115,640 B2 2/2012 Walls
8,536,990 B2 9/2013 Collins, Jr. et al.
8,537,008 B2 9/2013 Tallent et al.
8,604,917 B2 12/2013 Collins et al.
8,689,376 B2 4/2014 Becker et al.
8,694,600 B2 4/2014 Gaines et al.
8,866,598 B2 10/2014 Collins, Jr. et al.
8,917,166 B2 12/2014 Collins, Jr. et al.
8,943,168 B2 1/2015 Wiesner et al.
9,220,650 B2 12/2015 Bobey et al.
9,411,934 B2 8/2016 Robinson et al.
2002/0014115 A1 * 2/2002 Young ..... B60C 23/0416 73/146
2003/0034885 A1 * 2/2003 Catton ..... A61M 16/0051 340/506
2003/0187557 A1 * 10/2003 Shockley ..... G01M 17/007 701/39
2007/0163045 A1 * 7/2007 Becker ..... A61B 5/1115 5/616
2007/0210917 A1 * 9/2007 Collins, Jr. ..... A61B 5/1117 340/539.1
2011/0277242 A1 * 11/2011 Dionne ..... A61G 7/005 5/611
2012/0025990 A1 2/2012 Tallent et al.
2012/0112903 A1 5/2012 Kaib et al.
2012/0302975 A1 * 11/2012 Buan ..... A61M 1/0031 604/318
2014/0091913 A1 4/2014 Collins, Jr. et al.
2014/0259410 A1 * 9/2014 Zerhusen ..... A61G 7/00 5/600
2015/0082295 A1 3/2015 Collins, Jr. et al.
2016/0174909 A1 6/2016 Collins, Jr. et al.

* cited by examiner

BED ALERT CONDITION CONFIGURATION USING A REMOTE COMPUTER DEVICE

RELATED APPLICATIONS

This application claims priority under 35 U.S.C. § 119(e) to U.S. Provisional Application Ser. No. 62/247,383, filed Oct. 28, 2015, which is expressly incorporated by reference herein.

BACKGROUND

The present disclosure relates to hospital beds, and particularly to hospital beds that have alert indicators such as lights. More particularly, the present disclosure relates to hospital beds in communication with a remote computer device configured to control the alert indicators remotely.

Hospital beds having lights to alert caregivers of undesirable conditions are known. For example, the CENTRA™ bed marketed by Hill-Rom Company, Inc. starting in the early 1980's had four light emitting diodes (LED's) at the foot end of the bed in a vertical arrangement which indicated, respectively, an electrical ground loss, bed not in low position, bed motors locked out, and foot brake not set. In recent times, alert lights on beds have been made much larger and conspicuous so that caregivers can easily see these lights from a distance of ten feet or more. Thus, a caregiver is able to view the alert light status from a hallway by looking through a doorway of a patient room. See, for example, U.S. Pat. Nos. 8,464,380, 8,393,026, and 8,593,284.

These more recent types of alert lights typically are illuminated green to indicate that multiple monitored bed conditions are all in a desired state and are illuminated some other color, such as amber or red, to indicate that at least one of the monitored bed conditions is in an undesirable state. However, the alert conditions monitored by the bed are activated and inactivated through an interface attached to the bed. As such, when supervising a number of beds, the caregiver must visit each bed individually to set which alert conditions each bed monitors

SUMMARY

The present application discloses one or more of the features recited in the appended claims and/or the following features which, alone or in any combination, may comprise patentable subject matter:

In one aspect of the present disclosure, a patient support apparatus comprises a frame, a plurality of sensors, and a control system. The frame is configured to support a patient. The plurality of sensors configured for measuring conditions of the frame relating to a plurality of alert conditions in which at least one condition of the frame is in undesired states. The control system is configured to i) monitor the sensors corresponding to active alert conditions for undesired states, to ii) display information relating to active and inactive alert conditions so that a status of the alert conditions can be viewed and understood from a distance, and to iii) receive instructions from a remote computer device located remotely from the frame to configure any number of the alert conditions.

In some embodiments, the control system includes a controller and an alert light assembly. The controller is configured to monitor the plurality of sensors. The alert light assembly is configured to illuminate to convey information relating to the plurality of alert conditions.

In some embodiments, the alert light assembly includes a plurality of indicators that correspond with the plurality of alert conditions. Each indicator is configured to illuminate to convey information regarding a corresponding alert condition. In some embodiments, each indicator is configured to illuminate to indicate that the corresponding alert condition is active.

In some embodiments, each indicator is configured to illuminate green to indicate a satisfactory status of the corresponding active alert condition. Each indicator is configured to illuminate a color other than green to indicate an unsatisfactory status of the corresponding active alert condition.

In some embodiments, the controller communicates with the alert light assembly over a controller area network. In some embodiments, the control system is configured to communicate with the remote computer device over a wireless network.

In some embodiments, the patient support apparatus further includes an electronic display and the alert light assembly is included in the electronic display. In some embodiments, the control system is configured to communicate with the remote computer device over a wired network. In some embodiments, the plurality of alert conditions includes at least one of a weight/position alert condition, a head section angle alert condition, a bed height alert condition, a siderail alert condition, and a foot brake alert condition.

According to another aspect of the present disclosure, a patient support apparatus comprises a frame, a plurality of sensors, and a control system. The frame is configured to support a patient. The plurality of sensors is configured for measuring a plurality of alert conditions of the frame. The control system is configured to i) monitor active alert conditions, to ii) display information relating to active and inactive alert conditions, and to iii) receive instructions from a remote computer device located remotely from the frame to configure any number of the plurality of alert conditions.

In some embodiments, the control system includes a controller and an alert light assembly. The controller is configured to monitor the plurality of sensors and to receive instructions from the remote computer device. The alert light assembly is configured to illuminate to convey information relating to the plurality of alert conditions.

In some embodiments, the control system includes a plurality of indicators configured to illuminate to convey information regarding a corresponding alert condition. Each indicator is configured to illuminate to indicate that the corresponding alert condition is active.

In some embodiments, the control system includes a plurality of indicators configured to illuminate to convey information regarding a corresponding alert condition. Each indicator is configured to illuminate a first color to indicate a satisfactory status of the corresponding active alert condition. Each indicator is configured to illuminate a second color different from the first color to indicate an unsatisfactory status of the corresponding active alert condition.

According to another aspect of the present disclosure, a bed status system comprises a patient support apparatus and a remote computer device. The patient support apparatus is adapted to support a patient thereon. The patient support apparatus includes a controller and an alert light assembly. The controller is configured to configure a plurality of alert conditions of the patient support apparatus. The alert light assembly has separate indicators that are individually illuminated to convey information regarding respective alert conditions. The remote computer device is located remotely from the patient support apparatus and configured to instruct the controller to configure one or more alert conditions.

In some embodiments, the alert light assembly includes a plurality of indicators that correspond with the plurality of alert conditions. Each indicator is configured to illuminate to convey information regarding a corresponding alert condition.

In some embodiments, each indicator is configured to illuminate to indicate that the corresponding alert condition is active. In some embodiments, each indicator is configured to illuminate green to indicate a satisfactory status of the corresponding active alert condition and each indicator is configured to illuminate a color other than green to indicate an unsatisfactory status of the corresponding active alert condition.

In some embodiments, the bed status system further includes an electronic display. The alert light assembly is included in the electronic display. In some embodiments, the remote computer device is configured to instruct the controller to configure alert conditions based on information received from a hospital network.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
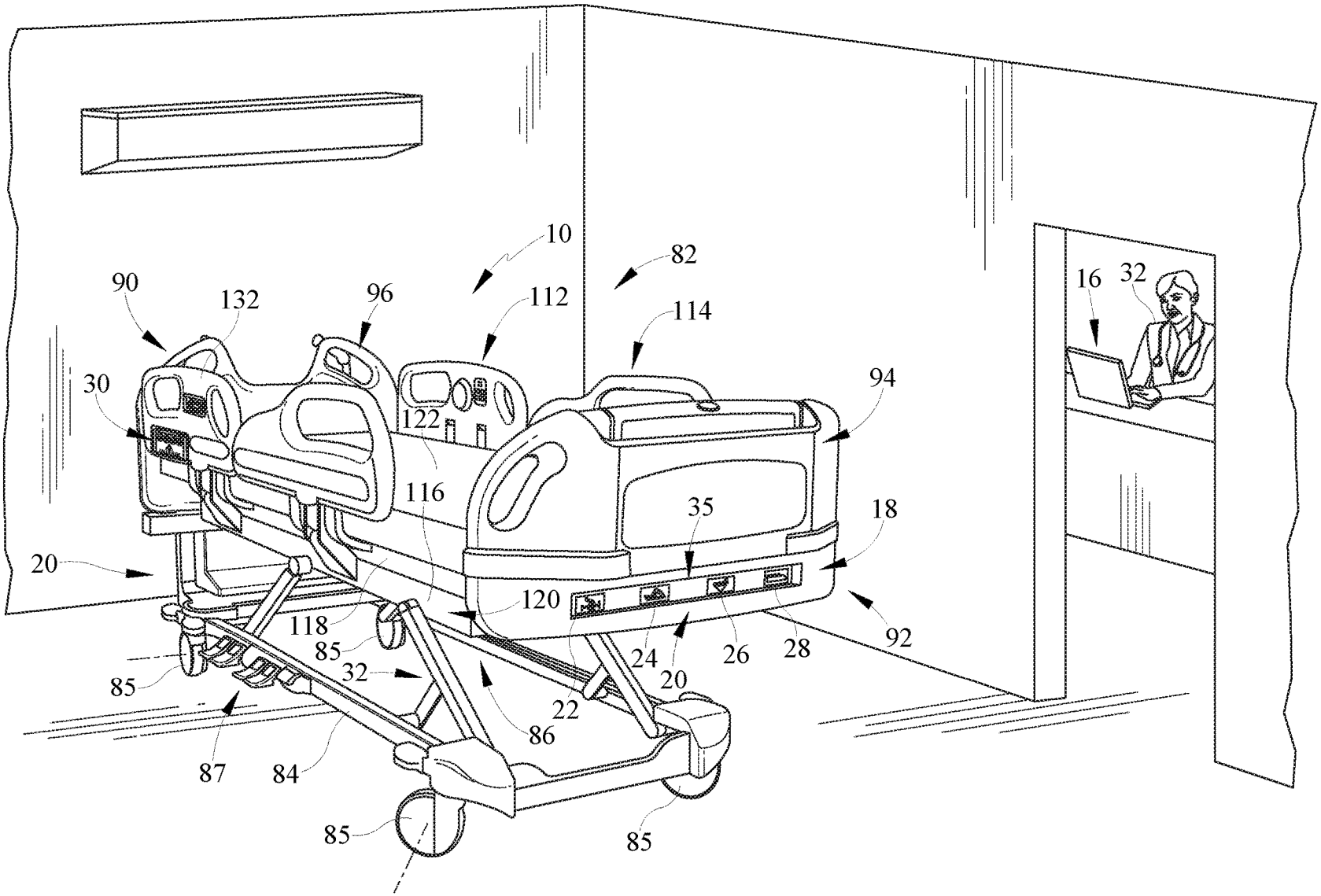
FIG. 1 is a perspective view of an alert light assembly attached to a foot of a patient support apparatus, shown here as a hospital bed, that is in communication with a remote computer device located at a care giver station outside of the room housing the hospital bed, the alert light assembly arranged to indicate the status of alert conditions monitored by the hospital bed, and suggesting that a caregiver may use the remote computer device to configure alert conditions monitored by the hospital bed.

A patient support apparatus, such as illustrative hospital bed 10, is configured to monitor bed conditions for alert conditions and indicate to a caregiver 32 if an alert condition is triggered as suggested in FIG. 1. Hospital bed 10 includes an alert light assembly 18 configured to display information relating to the alert conditions so that the status of the alert conditions can be viewed and understood from a distance. Caregiver 32 may use a remote computer device 16 to remotely configure and configure any number of alert condition monitors monitored by hospital bed 10. A plurality of indicators 20 included in alert light assembly 18 conspicuously indicates whether hospital bed 10 is monitoring one or more of the alert conditions. Alternatively or additionally, a GUI 30 of patient support apparatus 10 displays alert condition information such as, for example, as part of a screen saver.

Illustratively, the plurality of indicators 20 includes four indicators 22, 24, 26, 28 as shown in FIG. 1. When an alert condition monitor is active, the corresponding indicator 22, 24, 26, 28 indicates to caregiver 32 that hospitable bed 10 is monitoring the alert condition. For example, indicator 26 indicates whether a side rail position alert condition is being monitored by hospital bed 10. Furthermore, in some embodiments, indicators 22, 24, 26, 28 indicate to caregiver 32 the status of a monitored alert condition. As an example, indicator 26 illuminates a green color if the alert condition is being monitored, but is not triggered. Indicator 26, for example, illuminates an amber color if the alert condition is being monitored and if the alert condition has been triggered.

When an alert condition monitor is inactive, the corresponding indicator 22, 24, 26, 28 indicates that hospital bed 10 is not monitoring the alert condition. In the illustrative embodiment, indicators 22, 24, 26, 28 are not illuminated, sometimes referred to as being turned off or extinguished, to indicate that hospital bed 10 is not monitoring the corresponding alert condition.

In the illustrative embodiment, caregiver 32 may configure monitors for the alert conditions with both remote computer device 16 and a user interface 74 included in hospital bed 10 as shown in FIG. 1. As such, caregiver 32 has greater control of configuring and activating or inactivating alert condition montiors on one or more hospital beds 10. As an example, a healthcare facility maintains a list of alert conditions to be monitored for each patient in a wing of the healthcare facility. Using remote computer device 16, caregiver 32 remotely configures, and activates or deactivates the proper alert conditions being monitored for each hospital bed 10 in the wing. As such, caregiver 32 efficiently controls the alert conditions for a single hospital bed 10 or a plurality of hospital beds 10 from a single location. In some embodiments, the caregiver 32 may apply the same monitoring conditions to multiple hospital beds 10 simultaneously.

Hospital bed 10 shown in FIG. 1 is based on the VERSACARE™ bed marketed by Hill-Rom Company, Inc. However, the present disclosure is applicable to other patient support apparatuses including, for example, other types of beds, patient tables, stretchers, wheel chairs, and the like. Furthermore, use of the term "hospital bed" herein is intended to mean beds that support patients in all types of settings including, for example, nursing homes, outpatient facilities, medical clinics, and even a patient's own home, and is not intended to imply that such beds must be located in a hospital. As will be described in further detail below, the present disclosure is focused primarily on remote computer devices for configuring and monitoring various alert light assemblies that convey information regarding the status of multiple features or functions of bed 10.

Figure 2:
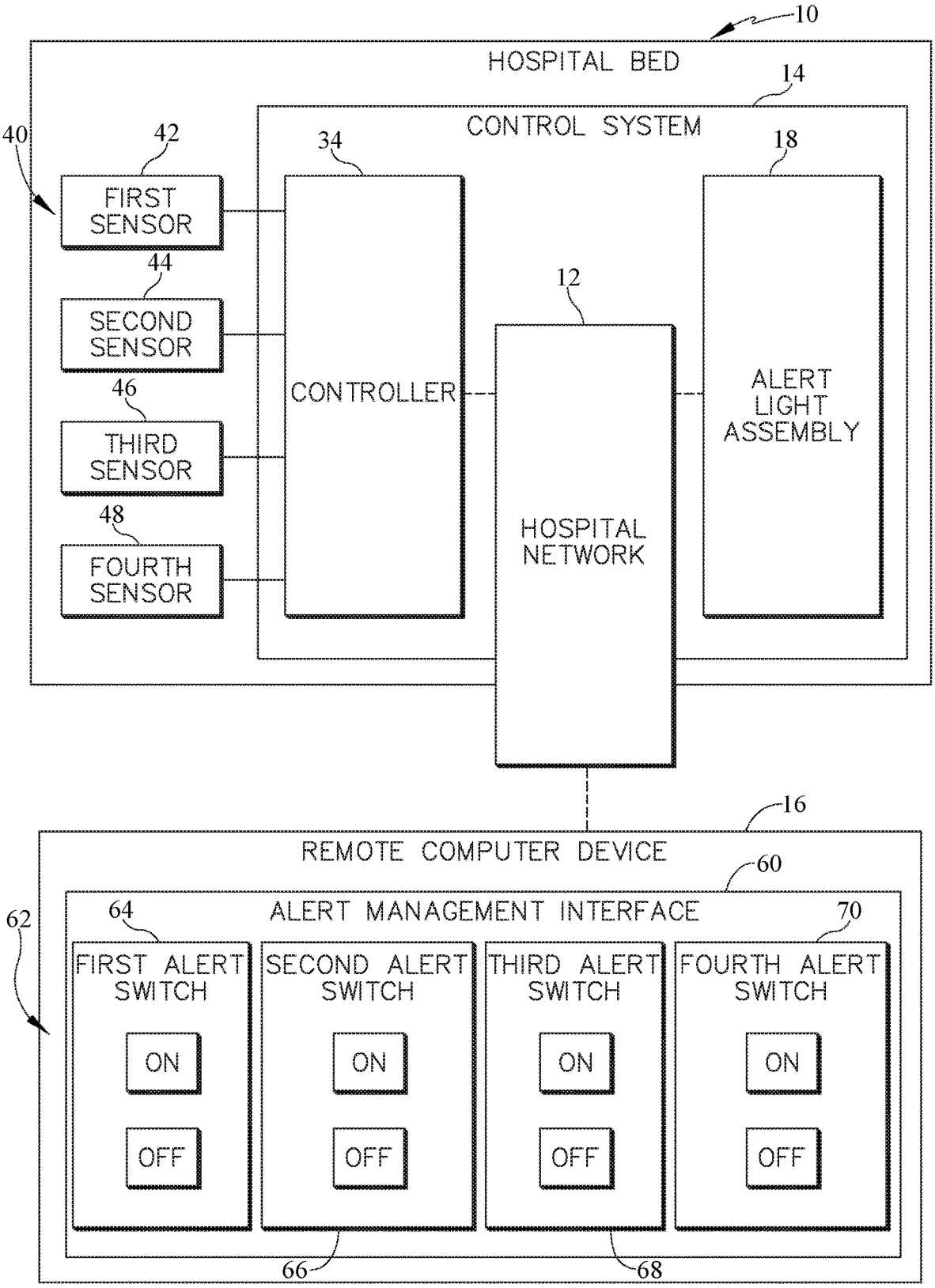
FIG. 2 is a block diagram of a hospital bed in communication with a remote computer device over a hospital network, the hospital bed including a number of sensors for monitoring alert conditions of the hospital bed and the alert light assembly configured to indicate the status of the alert conditions, and further showing the remote computer device arranged to remotely configure the alert conditions monitored by the hospital bed by communicating with the hospital bed over the hospital network.
Figure 3:
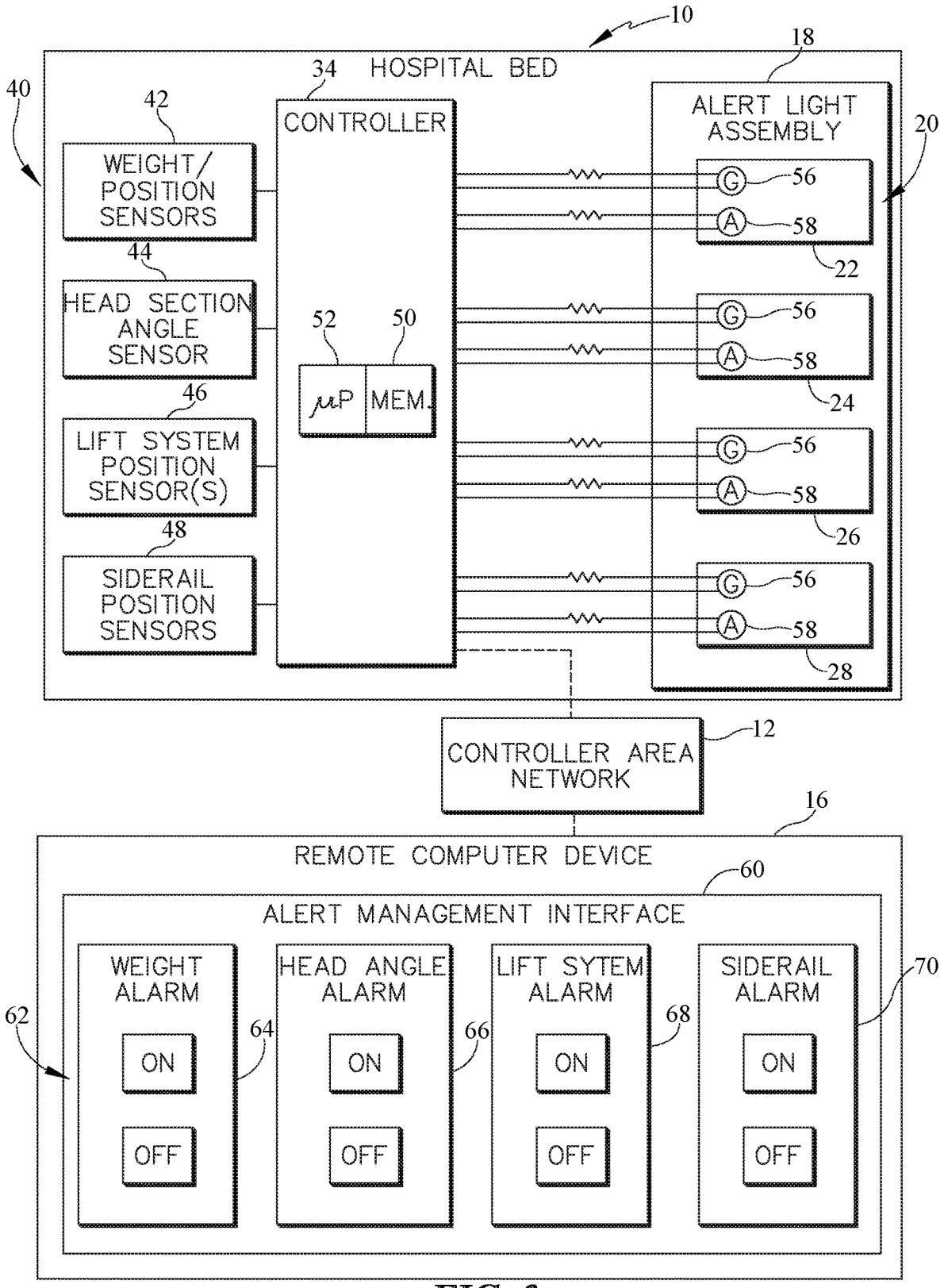
FIG. 3 is a block diagram of the hospital bed of FIG. 1 in communication with the remote computer device, the hospital bed includes four sensors configured to monitor alert conditions of the hospital bed and the alert light assembly includes four indicators configured to indicate the status of the alert conditions, and further showing the remote computer device arranged to remotely configure the alert conditions.

Hospital bed 10 illustratively includes a control system 14 in communication with a computer network or system 12 of the healthcare facility as suggested in FIG. 1 and shown diagrammatically in FIGS. 2 and 3. Control system 14 is configured to monitor and indicate the status of the alert conditions. In the illustrative embodiment, remote computer device 16 communicates with hospital bed 10 through computer network 12 to configure the alert conditions to be monitored. In other embodiments, remote computer device 16 communicates with hospital bed 10 directly. In some embodiments, hospital bed 10 is included in a bed status system. In one example, bed status system includes hospital bed 10 and remote computing device 16. In another example, bed status system includes hospital bed 10, computer network 12, and remote computer device 16.

Control system 14 is in communication with a plurality of sensors 40 as shown in FIG. 2. Sensors 40 measure properties of hospital bed 10 and send signals including information indicative of the measurements to control system 14. If an alert condition is active, control system 14 monitors the signals received from sensors 40 to determine if the alert condition has been triggered. In the illustrative embodiment, the plurality of sensors 40 includes four sensors 42, 44, 46, 48 as shown in FIG. 2. In the illustrative embodiment, first sensor 42 comprises a weight/position sensor 42, second sensor 44 comprises a head section angle sensor 44, third sensor 46 comprises a lift system position sensor 46, and fourth sensor 48 comprises a siderail position sensor 48 as shown FIG. 3.

In the illustrative embodiment, control system 14 is in direct communication with sensors 40. In other embodiments, control system 14 communications with sensors 40 via a module (not shown) included in hospital bed 10. In other embodiments, hospital bed 10 includes less than four sensors 40 in communication with control system 14, but at least one sensor 40. In other embodiments, hospital bed 10 includes more than four sensors 40 in communication with control system 14.

Control system 14 includes a controller 34 and alert light assembly 18 as shown in FIGS. 2 and 3. Controller 34 activates and deactivates alert condition to be monitored and, when monitoring is activated, monitors the signals from sensors 40 to determine if an active alert condition has been triggered based on the alert condition configuration. Alert light assembly 18 indicates to caregiver 32 whether one or more alert conditions are being monitored by control system 14. In the illustrative embodiment, alert light assembly 18 indicates the status of the one or more monitored alert conditions.

For all active alert conditions, controller 34 monitors the signals from sensors 40 and determines if an alert condition has been triggered. Controller 34 compares the information in the signal to the configured alert condition threshold values for each alert condition that controller 34 is monitoring. Illustratively, controller 34 includes a memory 50 and a microprocessor 52 as shown in FIG. 3. Memory 50 is configured to receive and store alert condition thresholds as configured by the caregiver 32. Microprocessor 52 is configured to monitor the sensor signals and compare the information in the signals to the alert condition threshold values.

In the illustrative embodiment, alert condition threshold values are inputted into controller 34 by caregiver 32 through remote computer device 16 or user interface 74. Alert condition thresholds may be configured or modified by caregiver 32 through remote computer device 16 or user interface 74. In other embodiments, controller 34 receives alert condition configuration threshold values from computer network 12.

If an alert condition is met or triggered by meeting the threshold condition, controller 34 instructs alert light assembly 18 to indicate which alert condition is has been met. In the illustrative embodiment, alert light assembly 18 continues to indicate that the alert condition has been triggered until caregiver 32 resets the alert condition. In other embodiments, alert light assembly 18 indicates that the alert condition has been triggered only when the triggering event of the alert condition is present. For example, if the alert condition is resolved, the controller 34 includes instructions which cause the alert condition indicator on the alert light assembly 18 to monitor the actual status. In some embodiments, controller 34 communicates with alert light assembly 18 through hospital network 12 as shown in FIG. 2. In other embodiments, controller 34 communicates with alert light assembly 18 directly, as shown in FIG. 3.

Alert light assembly 18 includes at least one indicator 20 configured to indicate to caregiver 32 the status of an alert condition as shown in FIGS. 2 and 3. The at least one indicator 20 may be, for example, a light or a display screen. As shown in FIG. 3, alert light assembly 18 illustratively includes four indicators 22, 24, 26, 28.

In the illustrative embodiment, indicators 20 include lenses 54 having indicia of alert conditions. Behind each of lenses 54 is at least one light emitter as shown in FIG. 3. In some embodiments, the at least one light emitter behind each lens 54 includes a first LED 56 that emits green light and a second LED 58 that emits amber or yellow light as shown diagrammatically in FIG. 3. In other embodiments, second LED emits some other color of light other than green, such as red or orange.

Controller 34 controls whether LED 56 of each indicator 22, 24, 26, 28 is lit, whether LED 58 of each indicator 22, 24, 26, 28 is lit, or whether nether LED 56 or LED 58 is lit depending upon the status of the monitored bed conditions. In some embodiments, controller 34 includes one or more LED driver integrated circuit (IC) chips (not shown) that control the application of current on conductors to illuminate the respective LED's 56, 58. Other light emitters for alert light assembly 18, including light bulbs of suitably small size, are within the scope of this disclosure.

Remote computer device 16 is configured to transmit instructions to control system 14 over computer network 12 to establish or deactivate alert conditions as shown in FIGS.

2 and 3. In other embodiments, remote computer device 16 communicates with control system 14 directly. Remote computer device 16 includes an alert management interface 60 shown diagrammatically in FIG. 2. Alert management interface 60 includes alert condition monitoring switches 62 for establishing and deactivating alert condition monitoring.

Alert condition monitoring switches 62 include an "ON" option for activating the alert condition and an "OFF" option for inactivating the alert condition. Caregiver 32 is able to activate an alert condition by selecting the "ON" option of the respective alert condition-monitoring switch and inactivate an alert condition by selecting the "OFF" option.

The "ON" option and the "OFF" option may be embodied by a number of different systems. The "ON" position includes any method of activating an alert condition monitor and the "OFF" position includes any method of inactivating an alert condition monitor. In some embodiments, the alert condition monitoring switches 62 are electric switches, such as, for example, toggle switches. In some embodiments, alert condition monitoring switches 62 are incorporated into a graphical display user interface as suggested in FIG. 4 and activated by logic of the controller 34.

In one embodiment, alert management interface 60 includes alert switches 64, 66, 68, 70 as shown in FIG. 2. A first alert switch 64 controls whether controller 34 monitors an alert condition corresponding to first sensor 42. A second alert switch 66 controls whether controller 34 monitors an alert condition corresponding to second sensor 44. A third alert switch 68 controls whether controller 34 monitors an alert condition corresponding to third sensor 46. A fourth alert switch 70 controls whether controller 34 monitors an alert condition corresponding to fourth sensor 48. Illustratively, the plurality of alert conditions includes a weight/position alert condition, a head section angle alert condition, a bed height alert condition, and a siderail alert condition. In other embodiments, the alert conditions include a foot brake alert condition.

In operation, caregiver 32 activates any number of alert conditions for hospital bed 10 by selecting the "ON" position for the respective alert switch 64, 66, 68, 70. Caregiver 32 inactivates any number of alert conditions for hospital bed 10 by selecting the "OFF" position for the respective alert switch 64, 66, 68, 70.

Figure 4:
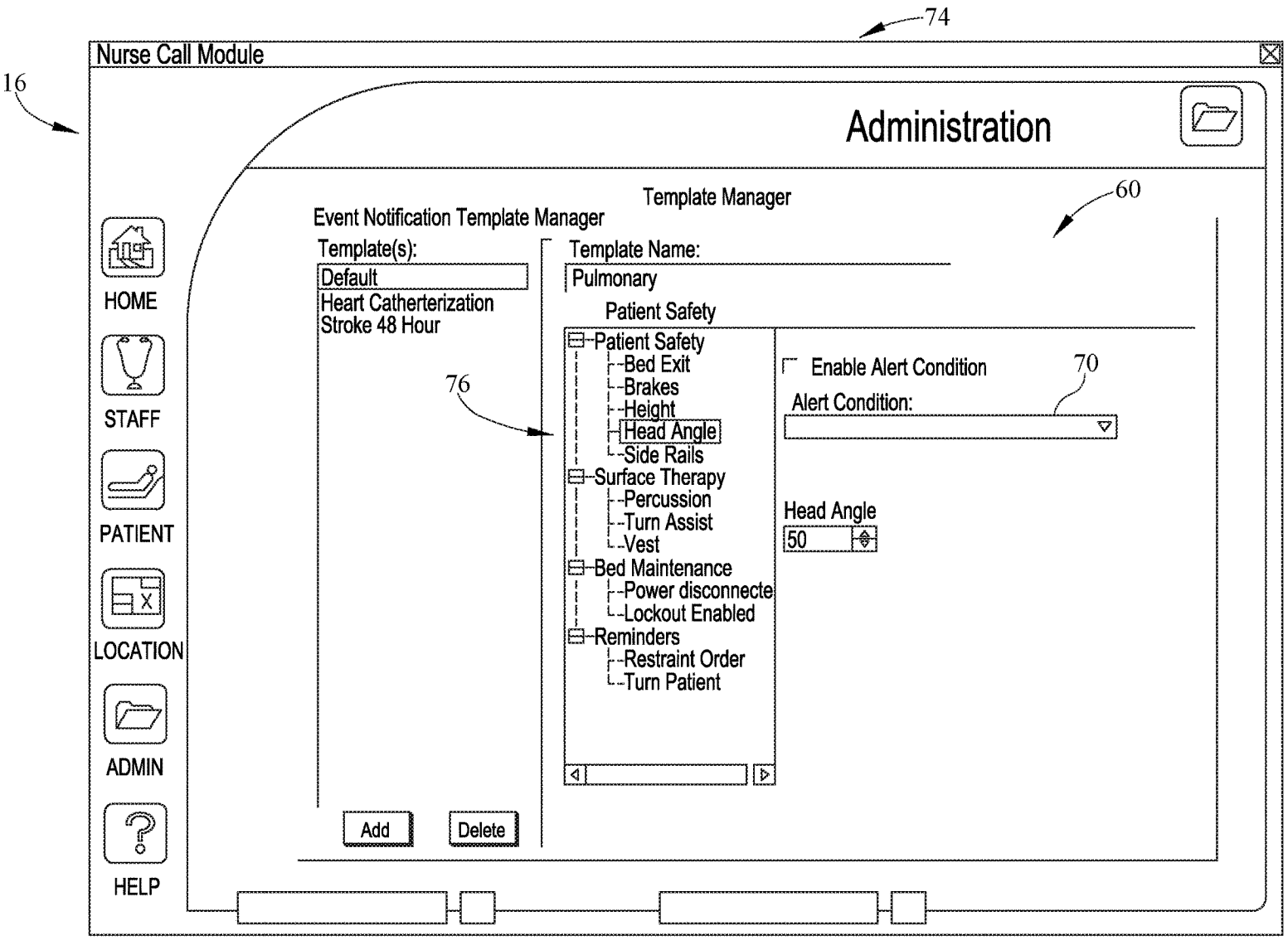
FIG. 4 is a screen shot of an illustrative remote computer device screen configured to configure at least one alert condition monitored by the hospital bed.

In another embodiment, alert condition monitoring switches 62 are part of a user interface 74 including menu options for caregiver 32 to set specific alert conditions for a given alert as shown in FIG. 4. Illustratively, the menu options provide caregiver 32 a list of bed functions 76. When a bed function 76 which may be monitored is selected, additional options to activate/inactivate alert conditions and configure alert condition threshold values appear on the menu. In other embodiments, user interface 74 is arranged with alternative menu architecture. In some embodiments, the alert condition being monitored could be a discrete condition such as whether a switch is active while in other embodiments the alert condition could be configured to be a particular value, such as change in weight being measured.

Figure 5:
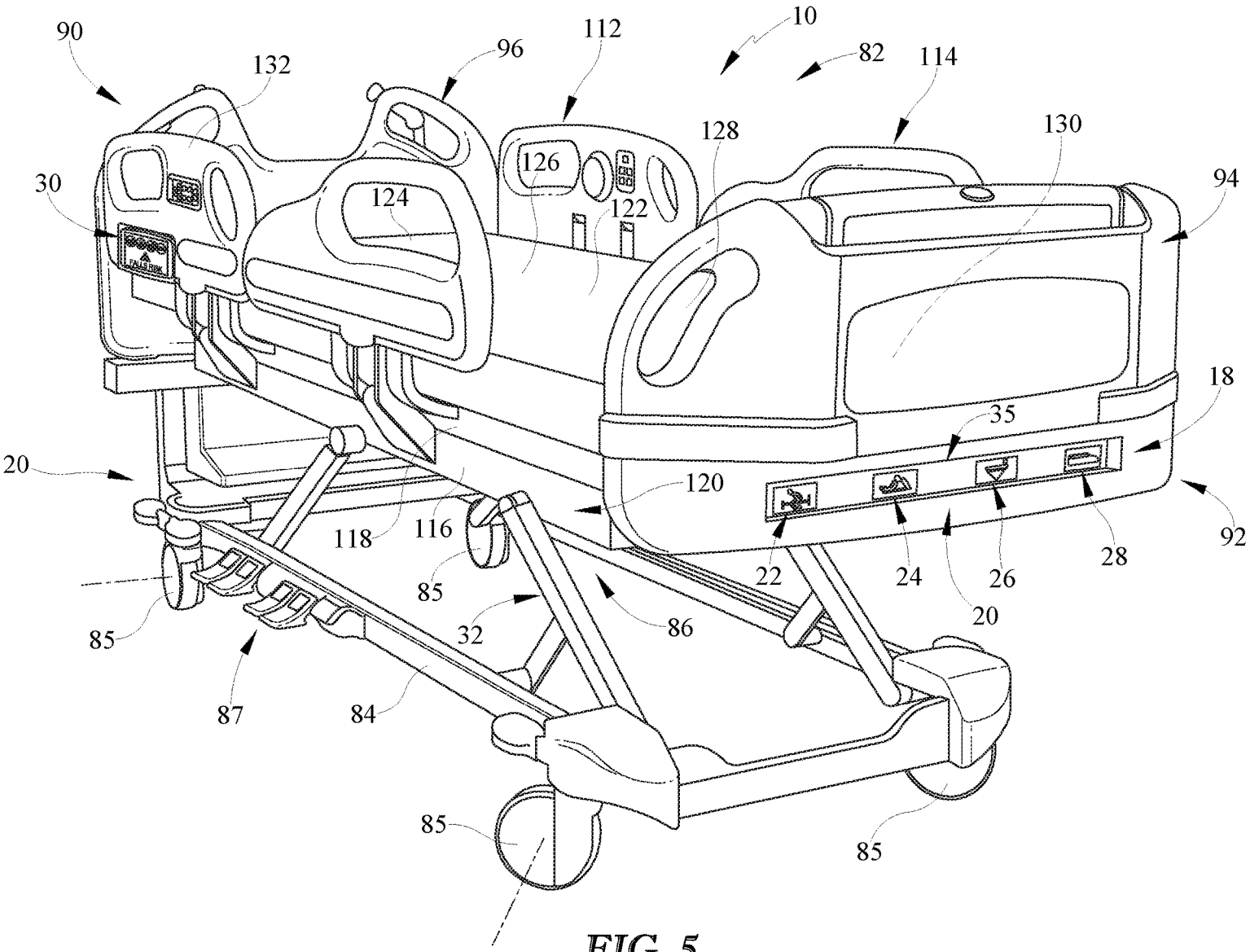
FIG. 5 is a perspective view of the hospital bed of FIG. 1, the hospital bed configured to selectively configure one or more alert conditions of the alert light assembly coupled to a footboard of the hospital bed to cause the alert light assembly to illuminate indicia when a corresponding alert condition is being monitored.

An illustrative embodiment of hospital bed 10 is shown in FIG. 5. Hospital bed 10 further includes a frame 80. Frame 80 of bed 10 includes a base frame 84, an upper frame assembly 86, a lift system 88 coupling upper frame assembly 86 to base frame 84, and a plurality of siderail assemblies 82. Lift system 88 is operable to raise, lower, and tilt upper frame assembly 86 relative to base frame 84. Bed 10 has a head end 90 and a foot end 92 that is spaced from head end 90 in a longitudinal dimension of bed 10. Hospital bed 10 further includes a footboard 94 at foot end 92 and a headboard 96 at head end 90. Base frame 84 includes wheels or casters 85 that roll along a floor (not shown) as bed 10 is moved from one location to another. A set of foot pedals 87 are coupled to base frame 84 and are used to brake and release casters 85.

Illustrative hospital bed 10 includes four siderail assemblies 82 coupled to upper frame assembly 86 as shown in FIG. 5. Siderail assemblies 82 include a pair of head siderail assemblies 112 (sometimes referred to as head rails) and a pair of foot siderail assemblies 114 (sometimes referred to as foot rails). Siderails 112 are spaced from each other in a lateral dimension of bed 10 and the same can be said of siderails 114. Each of siderail assemblies 112, 114 is movable between a raised position, as shown in FIG. 5, and a lowered position (not shown). Siderail assemblies 112, 114 are sometimes referred to herein as siderails 112, 114.

Upper frame assembly 86 includes a lift frame 116, a weigh frame 118 supported with respect to lift frame 116, and a patient support deck 120 carried by weigh frame 118. Each of frames 116, 118, 120, either individually or collectively, is considered to be an "upper frame" according to this disclosure. Thus, patient support apparatuses that omit one or more of frames 116, 118, 120 but yet still have an upper frame are within the scope of this disclosure. As such, upper frame 86 is considered to be the portion of bed frame 80 that is moved by lift system 88 relative to base frame 84, regardless of its configuration. Accordingly, upper frame assembly 86 is sometimes referred to herein as upper frame 86.

Patient support deck 120 is carried by weigh frame 118 and engages a bottom surface of mattress 122. Patient support deck 120 includes a head section 124, a seat section 126, a thigh section 128 and a foot section 130 in the illustrative example as shown in FIG. 5. The placement of reference numerals 124, 126, 128, 130 in FIG. 5 generally denotes the location of the corresponding sections. Sections 124, 128, 130 are each movable relative to weigh frame 118. For example, head section 124 pivotably raises and lowers relative to seat section 126 whereas foot section 130 pivotably raises and lowers relative to thigh section 128. Additionally, thigh section 128 articulates relative to seat section 126. Also, in some embodiments, foot section 130 is extendable and retractable to change the overall length of foot section 130 and therefore, to change the overall length of deck 120.

Each siderail 112 includes a first user control panel 30 coupled to the outward side of an associated barrier panel 132. Control panel 30 includes various buttons that are used by caregiver 32 to control associated functions of bed 10. For example, control panel 30 includes buttons that are used to raise and lower head section 124, buttons that are used to operate knee motor to raise and lower thigh section 128, and buttons that are used to raise, lower, and tilt upper frame assembly 86 relative to base frame 84.

Alert light assembly 18 is attached to a lateral frame member of foot section 130 of deck 120 as shown in FIG. 5. Alert light assembly 18 has an elongated bar or housing 35 that carries indicators 22, 24, 26, 28. Thus, alert light assembly 18 is sometimes referred to as a "light bar."

Figure 6:
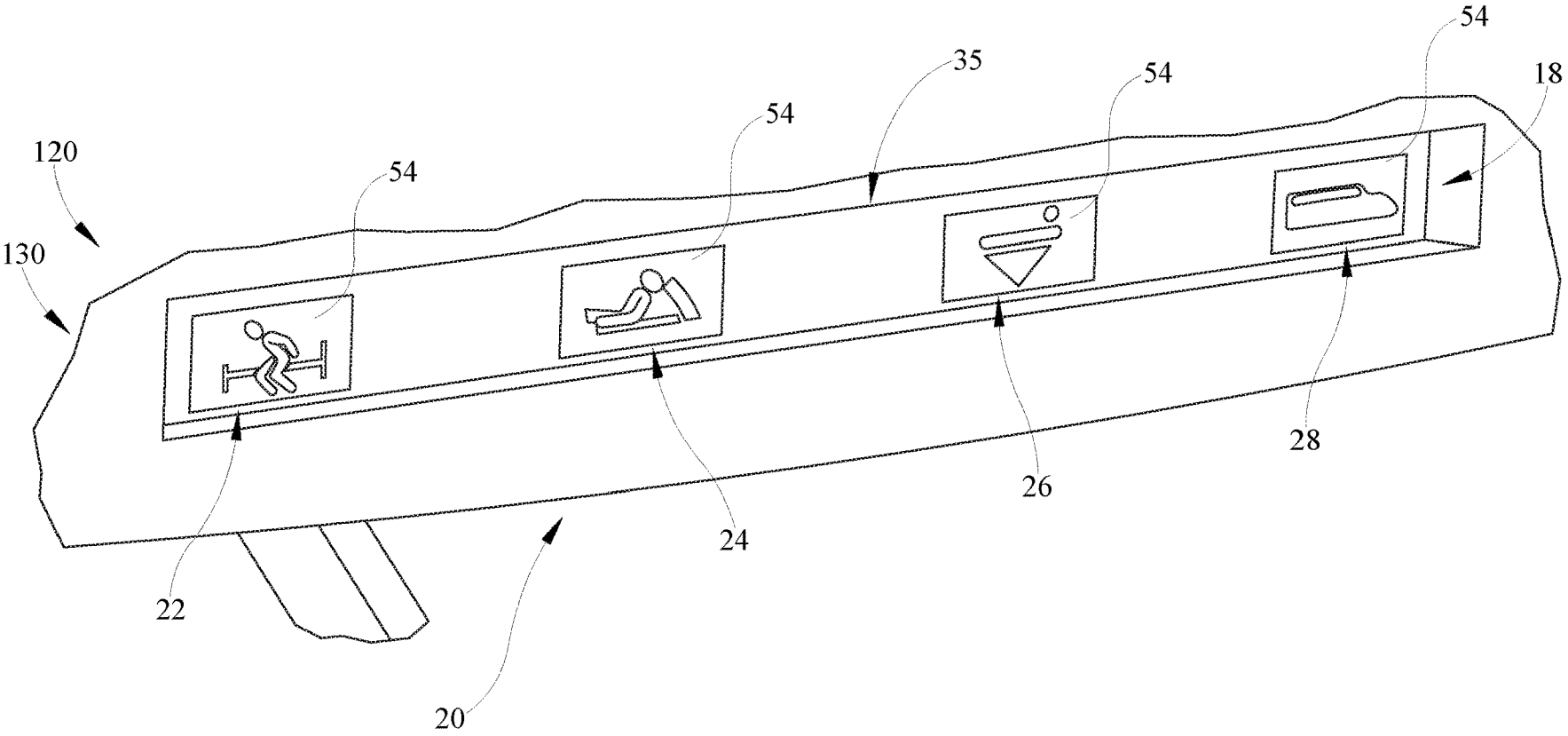
FIG. 6 is an enlarged perspective view of the alert light assembly of FIG. 5, the alert light assembly includes indicia associated with four separate indicators of the assembly, and each indicator is illuminated when the corresponding alert condition is being monitored.

In the example of FIGS. 5 and 6, each indicator 22, 24, 26, 28 is approximately square in shape or slightly rectangular. Accordingly, when any of indicators 22, 24, 26, 28 are illuminated, they can be viewed and understood from a distance that is on the order of ten to twenty feet away. Thus, a caregiver standing in a hallway of healthcare facility and looking through the door of a patient room will easily be able to discern which of indicators 22, 24, 26, 28 is illuminated green or illuminated a color other than green, such as red, orange, or amber, or not illuminated at all. In some embodiments, the indicators 22, 24, 26, 28 may be arranged to provide an indirect illumination or projections, such as projecting an image on the floor below the bed 10.

Each lens 54 is translucent such that light appears to be emitted from each lens 54 across the entire surface area of lens 54. Each lens 54 has an indicia provided thereon which blocks the emitted light from passing through the indicia. The indicia on lenses 54 of each indicator 22, 24, 26, 28 relates to a particular bed function such that each indicator 22, 24, 26, 28 is illuminated in a manner to indicate a satisfactory status or unsatisfactory status of four different bed conditions, assuming the particular bed condition is being monitored. If a particular condition of bed 10 associated with one or more of indicators 22, 24, 26, 28 is not being monitored, then the light emitter(s) associated with that indicator is turned off altogether. In some embodiments, lenses 54 are frosted in appearance.

In the illustrative example shown in FIG. 6, indicator 22 is associated with a bed exit or ppm function of the scale/ppm system of bed 10. Thus, the indicia of indicator 22 is an icon of a person starting to exit the bed and stand up. Thus, when the ppm system of bed 10 is armed such that a patient's position on bed 10 is being monitored by controller 34 of bed 10 in a known manner, indicator 22 is illuminated green to indicate a satisfactory status if the patient is within a range of permissible positions on bed 10 and indicator 22 is illuminated a color other than green (e.g., amber, red, or orange) to indicate an unsatisfactory status if the patient has moved outside the range of permissible positions. Bed exit is one of the modes or levels of sensitivity of the ppm system, as is well-known in the art.

In the illustrative example shown in FIG. 6, indicator 24 is associated with a head of bed (HOB) angle. Thus, bed 10 includes angle sensor 44, shown diagrammatically in FIG. 3, such as a potentiometer or accelerometer that measures an angle at which head section 124 of deck 120 is raised relative to frame 118, in the case of the potentiometer, or relative to horizontal, in the case of the accelerometer. When the HOB angle monitoring feature is armed, indicator 24 is illuminated green to indicate a satisfactory status when head section 124 is raised above the threshold angle configured by the caregiver 32 and indicator 24 is illuminated a color other than green to indicate an unsatisfactory status when head section 124 is below the threshold angle. The indicia of indicator 24 is an icon of a patient's torso raised up through an arc. If the HOB monitoring function of bed 10 is disarmed, then indicator 24 is not illuminated any color.

In the illustrative example of FIG. 6, indicator 26 is associated with a bed height monitoring system. Thus, a height at which lift system 88 supports lift frame 116 relative to base frame 84 is monitored by controller 34 of bed 10 based on electrical inputs from one or more lift system position sensors 46 as indicated diagrammatically in FIG. 3. Under typical use conditions when a patient is in bed 10, it is preferable that lift frame 116, and therefore weigh frame 118, be placed in its lowermost position relative to base frame 84. Thus, in some embodiments, the actuators of lift system 88 have sensors 46, such as potentiometers or shaft encoders that produce signals which correlate to a position at which lift system 88 supports frame 116 relative to base frame 84.

When the height monitoring system of bed 10 is armed, indicator 26 is illuminated green to indicate a satisfactory status when lift frame 116 is in its lowermost position (sometimes referred to as a "lowered position") and indicator 26 is illuminated a color other than green to indicated an unsatisfactory status when some or all of lift frame 116 is moved out of the lowered position. The indicia of indicator 26 is an icon of a patient lying horizontally with a down arrowhead icon beneath the patient. If the bed height monitoring system of bed 10 is disarmed, then indicator 26 is not illuminated any color.

In the illustrative example of FIG. 6, indicator 28 is associated with a siderail position monitoring system of bed 10. Thus, bed 10 has sensors 48 which monitor the position of each of siderails 112, 114 as is well-known in the art. Sensors 48 to monitor siderail position comprise of, for example, limit switches or magnetic switches such as switches having Hall effect sensors. In some embodiments, the particular siderails 112, 114 to monitor is selectable by a caregiver using one of control panels 30 and remote computer device 16 for example. Thus, among the four siderails 112, 114 of bed 10, caregiver 32 is able to select whether one, two, three or four of them are monitored. In other embodiments, bed 10 defaults to monitoring the position of all four siderails when the siderail monitoring system is armed.

For each of the monitored siderails, when the siderail monitoring system is armed, a satisfactory status is considered to exist when all of the monitored siderails 112, 114 are in the raised position as shown in FIG. 5. If any one or more of the monitored siderails 112, 114 is lowered while the siderail monitoring system is armed, that is considered to be an unsatisfactory status. Indicator 28 is illuminated green when a satisfactory status is detected and indicator 28 is illuminated a color other than green when an unsatisfactory status is detected. The indicia of indicator 28 is a siderail icon. If the siderail monitoring system of bed 10 is disarmed, then indicator 28 is not illuminated any color.

Figure 7:
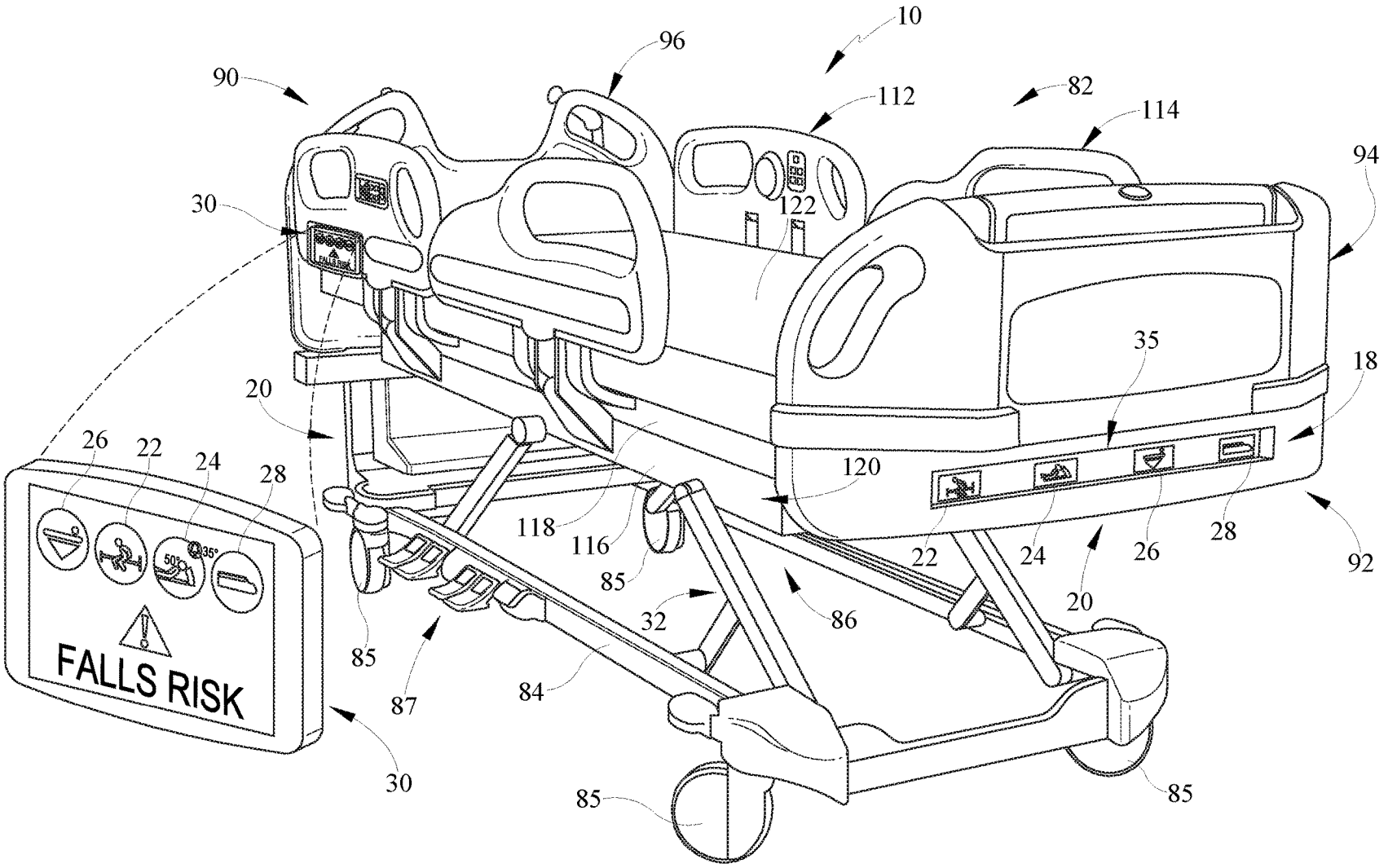
FIG. 7 is a perspective view of an alternative hospital bed showing an enlarged graphical user interface (GUI) moved away from a siderail of the hospital bed, the GUI displaying alert icons in response to activated alert conditions, and the GUI configured to receive instructions from a remote computer device to configure one or more of the monitored alert conditions.

As shown in FIG. 7, indicators 20 may be displayed on control panel 30 in some embodiments. When a monitored alert condition is active, indicia corresponding to the alert condition is displayed on control panel 30 so that the indicia may be seen from a distance. If a monitored alert condition is triggered, control panel 30 displays indicia to inform caregiver 32 that the alert condition has been triggered. In the illustrative embodiment, control panel 30 displays an alarm bell depiction over the alert condition. In some embodiments, control panel 30 sounds an audible alarm when an alert condition is triggered in addition to displaying indicia.

Although certain illustrative embodiments have been described in detail above, variations and modifications exist within the scope and spirit of this disclosure as described and as defined in the following claims.

The invention claimed is:

1. A patient support apparatus comprising a frame configured to support a patient, a plurality of sensors for measuring conditions of the frame relating to a plurality of alert conditions in which at least one condition of the frame is in undesired states, and a control system configured to i) monitor the sensors corresponding to active alert conditions for undesired states, to ii) display information relating to active and inactive alert conditions so that a status of the alert conditions can be viewed and understood from a distance, and to iii) receive instructions from a remote computer device located remotely from the frame to configure any number of the alert condition monitors, wherein the control system includes a controller configured to monitor the plurality of sensors and an alert light assembly configured to illuminate to convey information relating to the plurality of alert conditions, and wherein the alert light assembly includes a plurality of indicators that correspond with the plurality of alert conditions and each indicator is configured to illuminate to convey information regarding a corresponding respective alert condition, wherein each of the plurality of indicators is configured to be individually illuminated in a first color when monitoring of the corresponding alert condition is armed and the alert condition is not triggered, illuminated in a second color when monitoring of the corresponding alert condition is armed and the alert condition is triggered, and extinguished when monitoring the corresponding alert condition is disarmed, wherein each indicator includes a lens having indicia of the respective alert condition and, when the indicator illuminated in the first or second color, the indicia is illuminated in the respective color, wherein in response to one indicator of the plurality of indicators indicating the corresponding alert condition is active, the rest of the plurality of indicators are configured to remain operable to indicate the corresponding status of their respective sensors while the alert condition is resolved and the one indicator of the plurality of indicators that is indicating the alert condition is reset.

2. The patient support apparatus of claim 1, wherein each indicator is configured to illuminate green to indicate a satisfactory status of the corresponding active alert condition and each indicator is configured to illuminate a color other than green to indicate an unsatisfactory status of the corresponding active alert condition.

3. The patient support apparatus of claim 1, further comprising an electronic display and the alert light assembly is included in the electronic display.

4. The patient support apparatus of claim 1, wherein the controller communicates with the alert light assembly over a controller area network.

5. The patient support apparatus of claim 1, wherein the control system is configured to communicate with the remote computer device over a wireless network.

6. The patient support apparatus of claim 1, wherein the control system is configured to communicate with the remote computer device over a wired network.

7. The patient support apparatus of claim 1, wherein the plurality of alert conditions includes at least one of a weight/position alert condition, a head section angle alert condition, a bed height alert condition, a siderail alert condition, and a foot brake alert condition.

* * * * *